US005897402A

United States Patent [19]

Sasai et al.

[11] Patent Number: 5,897,402

[45] Date of Patent: Apr. 27, 1999

[54] RELEASABLE LOCKING CONNECTOR

[75] Inventors: Osamu Sasai; Hideto Nakamura; Hisashi Konoya, all of Yokkaichi, Japan

[73] Assignee: Sumitomo Wiring Systems, Ltd., Japan

[21] Appl. No.: 08/905,291

[22] Filed: Aug. 1, 1997

[30] Foreign Application Priority Data

Aug. 1, 1996 [JP] Japan ..... 8-203947
Nov. 25, 1996 [JP] Japan ..... 8-313819

[51] Int. Cl.[6] ..... H01R 13/434

[52] U.S. Cl. ..... 439/752; 439/748

[58] Field of Search ..... 439/752, 595, 439/746–749

[56] References Cited

U.S. PATENT DOCUMENTS 5,346,414 9/1994 Sakai et al. .
5,378,176 1/1995 Sasai .
5,501,619 3/1996 Sakatani et al. ..... 439/752
5,651,703 7/1997 Sasai ..... 439/752

OTHER PUBLICATIONS

JP Utility Model Unexamined Publication No. 4–91077.
European Search Report EP 97113113.1.

*Primary Examiner*—Gary Paumen
*Attorney, Agent, or Firm*—Jordan B. Bierman; Bierman, Muserlian and Lucas

[57] ABSTRACT

A releasable locking connector wherein the terminals are locked in place by a retainer which has an engagement position and a release position. In the former, a portion of the retainer bears against the rear of the terminals so that they cannot be removed. Also, a lance is provided on the terminals which bears against a stop surface of the housing. To permit removal of the terminal, a tool opening is provided so that the lance can be depressed to a position in which it no longer abuts the stop surface. When the retainer is in the engagement position, a closure thereon overlies the tool opening, thereby preventing entry of unwanted foreign material.

20 Claims, 8 Drawing Sheets

RELEASABLE LOCKING CONNECTOR

This Application claims the benefit of the priorities of Japanese Application 8-203947, filed Aug. 1, 1996 and Japanese Application 8-313819, filed Nov. 25, 1996.

The present Invention is directed to an improved releasable locking connector; in particular, a connector wherein the terminals can be easily replaced even though they are securely held within the connector.

BACKGROUND OF THE INVENTION

Connectors of this type include a metal terminal inserted into the cavity of the connector housing. An engagement mechanism, such as a lance formed by cutting and bending a section of the terminal, engages the housing and prevents unwanted withdrawal of the terminal from the housing. In addition, a retainer is mounted on the housing at an engagement position which additionally blocks removal of the terminal from the housing.

When servicing such connectors (e.g. replacing the terminals), the old terminal must be removed from the cavity. If the terminal is doubly engaged, the retainer must first be moved out of its engagement position into a release position; this will disable the secondary blocking means. After this has been accomplished, the engagement mechanism (lance) must be released.

While the retainer can be easily moved out of the engagement position, because the lance or other engagement mechanism is positioned inside the cavity, it is not easy to release. The user must insert a specially made long thin tool into the front of the cavity and probe around in order to contact the lance. Once contact is made, the lance can be pressed out of abutment with the housing and the terminal removed.

On the other hand, if a tool opening, to allow access to the lance, is formed in the housing, it would allow debris to enter and adhere to the terminals. This would impair the electrical conductivity and compromise the integrity of the connector.

SUMMARY OF THE INVENTION

The present Invention was developed in order to solve the foregoing problems. It is an object of this Invention to provide a connector wherein the terminal can be simply and readily withdrawn from the housing and, at the same time, which effectively prevents debris from entering the housing.

The present Invention is a locking connector, used in connection with one or more insulated cables, comprising a housing and at least one retainer. The housing contains one or more cavities and there is a terminal in each cavity. The terminals are adapted to mate with a complementary element to complete the connection. A lance is provided on the terminal which abuts a stop surface on the housing and thereby prevents withdrawal of the terminal therefrom. A tool opening, to permit access to the lance, is provided in the housing and aligned with the lance. The retainer comprises a closure and has an engagement position, wherein the closure covers the tool opening, and a release position, wherein the closure does not cover the tool opening.

The tool opening is uncovered when the retainer is in the release position and, in this condition, a tool can be passed through the opening to exert pressure on the lance. This pressure bends the lance so that it is no longer in abutment with the housing and allows the terminal to be easily withdrawn from the cavity.

Additionally, there is a detent on the retainer which bears against a portion of a terminal when the retainer is in the engagement position, thus preventing withdrawal thereof. However, when the retainer is moved to its release position, the detent is moved out of alignment with the withdrawal path of the terminal and, at the same time, the tool opening is exposed. This permits introduction of the tool itself which presses the lance up against the terminal and out of abutment with the housing, thereby permitting ready withdrawal of the terminal. When a new terminal has been inserted, the resilience of the lance causes it to spring outward and abut the housing, thereby locking it in place. Thereafter, the retainer is moved from its release position to its engagement position, thus bringing the closure into a position in which it overlies the tool opening and prevents entry of any extraneous material.

In a preferred form of the device, there are two retainers, one on either surface thereof. They are substantially the same except for a cutout portion on one retainer which receives the locking arm on the corresponding surface of the housing.

In a second embodiment of the present Invention, the retainer, instead of being capable of movement parallel to the insertion direction of the terminals, moves transversely thereto. In this form of the device, when the retainer is shifted into its release position, the terminal projections move out of the withdrawal path of the terminals. In addition, the closures move out of alignment with the tool openings. Conversely, when the retainer is shifted into its engagement position, the terminal projections line up with and abut the terminals and the closures overlie the tool openings. These results are accomplished with a single movement of the retainer.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
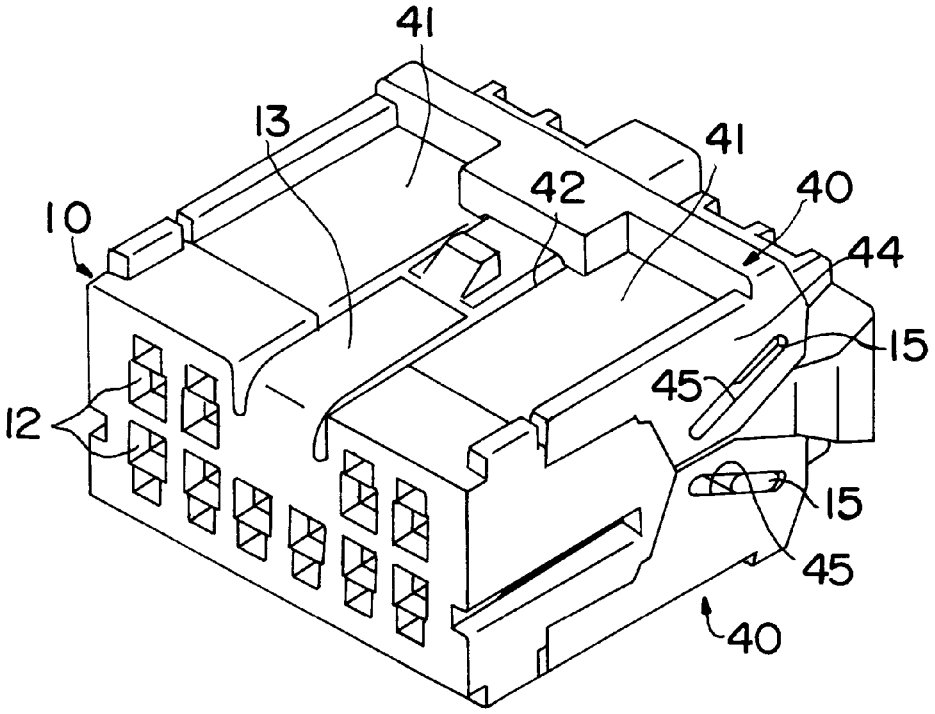
FIG. 1 is a perspective view of a connector according to the present Invention wherein the retainer is in its engagement position.

Referring to FIGS. 1 to 5, housing 10 contains cavities 11 having front insertion openings 12. Upper and lower retainers 40 are movably affixed to housing 10 and consist of main plates 41 and, in the case of upper retainer 40, cutout 42. Locking arm 13 fits into cutout 42. Side walls 44 are provided with elongated slots 45 which receive outer pins 15 and inner pins 16. Elongated slots 45 are angled so that, as retainer 40 is pressed into its engagement position, it is forced against housing 10 and secured thereto. Within each cavity 11 is female connector 23 consisting of at least one terminal 20 having wire barrel 21, which grips core wire 31, and insulation barrel 22 which grips cable 30 by its insulation.

Figure 2:
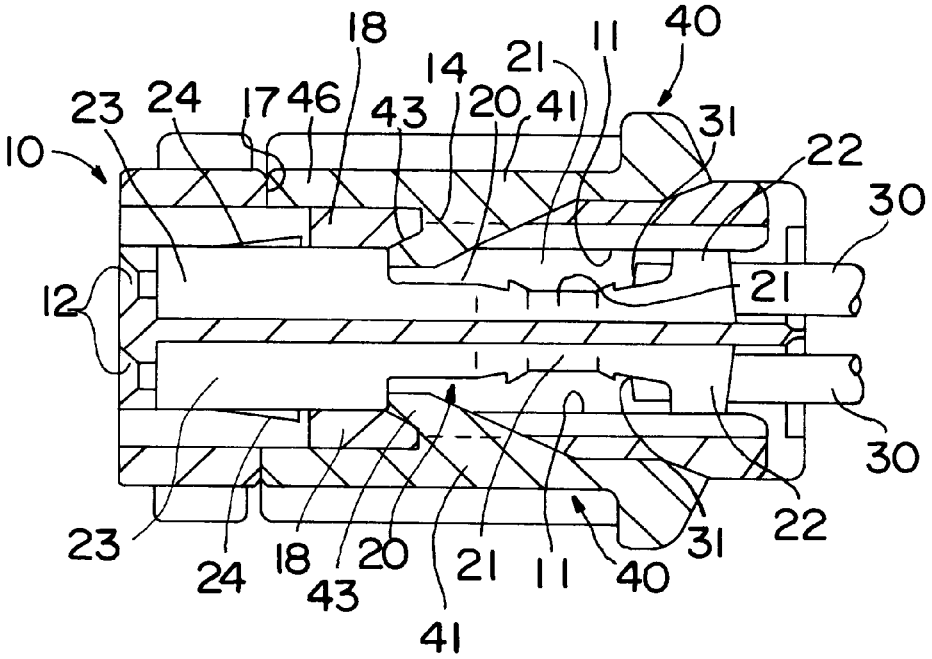
FIG. 2 is a vertical cross section of the connector of FIG. 1.

Retainers 40 are provided with main plates 41 and retainer projections 43 which extend therefrom toward terminals 20. When retainers 40 are in their engagement positions, as shown in FIGS. 1 and 2, retainer projections 43 extend through openings 14 and bear against stop surfaces 18. At the contact point between stop surfaces 18 and retainer projections 43, a slant is provided to urge retainers 40 against the upper and lower surfaces of housing 10. Lances 24 bear against stop surfaces 18 which are mounted on housing 10. Thus, terminals 20 cannot be removed from cavities 11 in this configuration.

Figure 3:
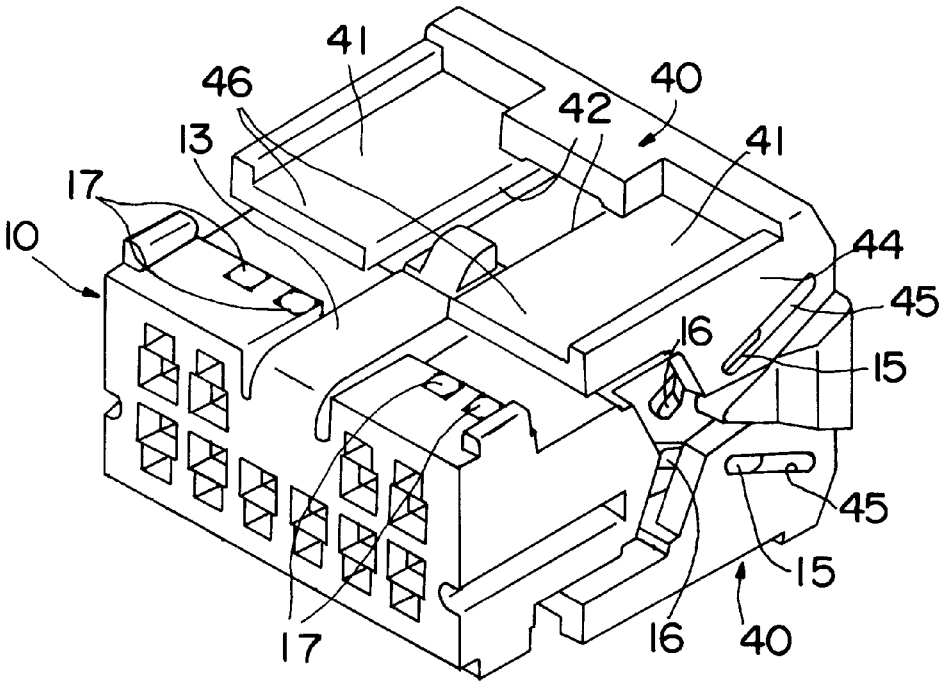
FIG. 3 is a view, similar to that of FIG. 1, with the retainer in its release position.
Figure 4:
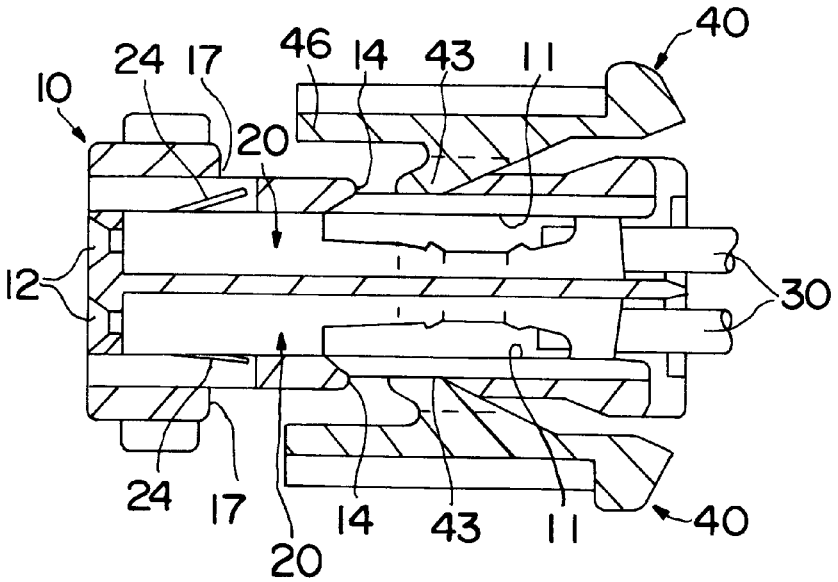
FIG. 4 is a vertical section of the connector as shown in FIG. 3.
Figure 5:
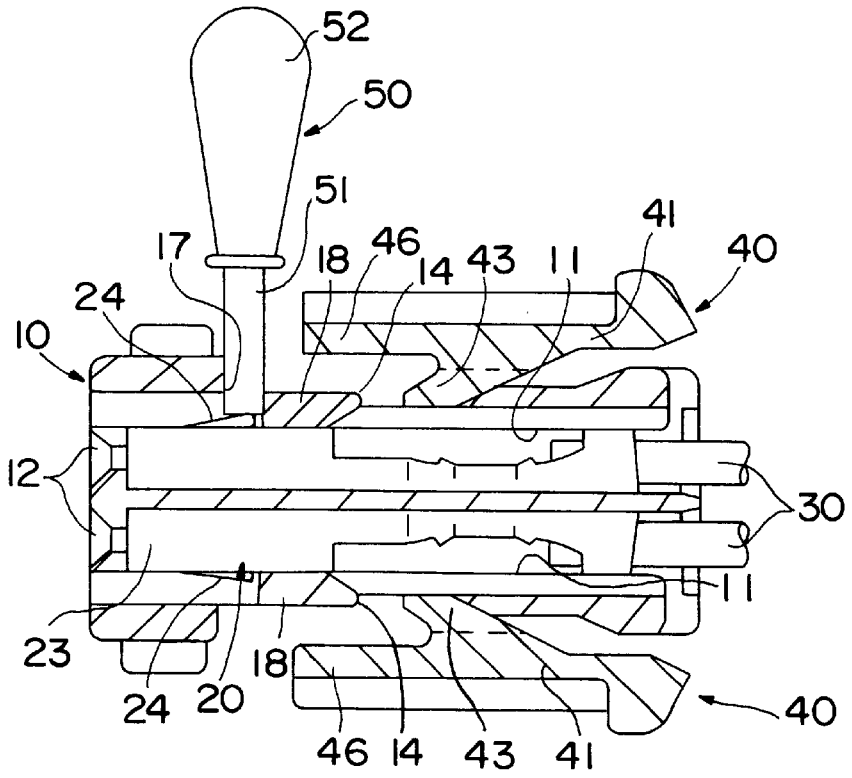
FIG. 5 is a view, similar to FIG. 4, showing the tool in use.
Figure 6:
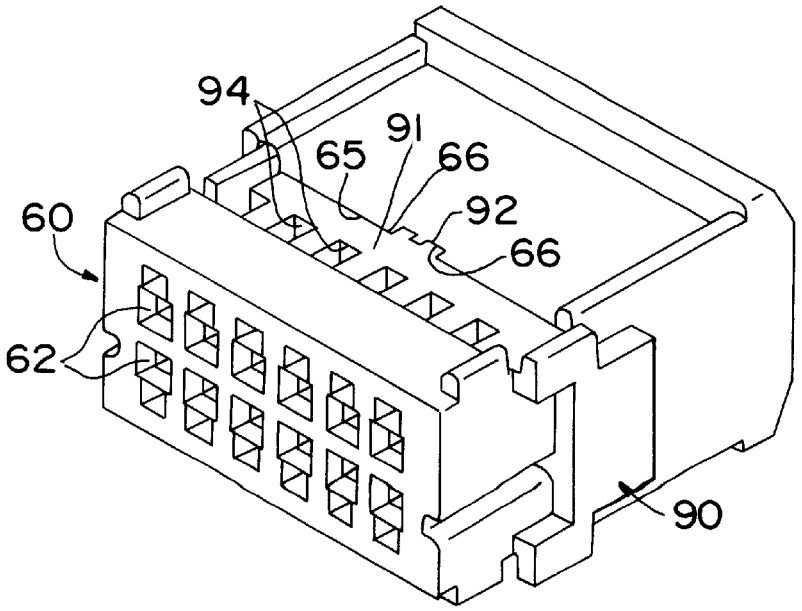
FIG. 6 is a perspective view of the second embodiment of the present Invention.
Figure 7:
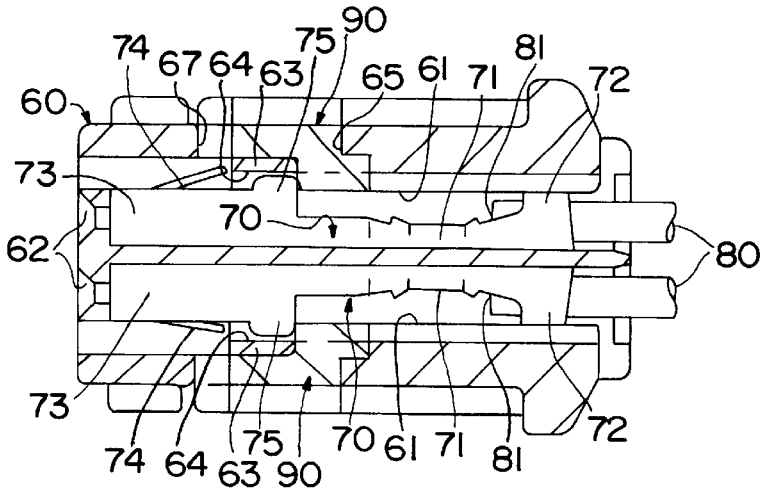
FIG. 7 is a vertical cross section of FIG. 6.

Should the connector require disassembly for servicing or any other purpose, a sharp pointed tool is inserted in the gap between housing 10 and retainers 40 and upper and lower retainers 40 are moved rearward, away from insertion openings 12, to the release position as shown in FIGS. 3, 4, and 5. When this is done, as best shown in FIG. 4, closure 46 moves away from tool opening 17, thereby exposing it for entry of the tool. At the same time, retainer projections 43 move out of alignment with detent opening 14. Thereafter, as shown in FIG. 5, tool 50, having grip 52, is inserted into tool opening 17. Pressure pin 51 is then pressed against lance 24 to move it out of abutment with stop surface 18. Terminals 20 can then be easily removed by withdrawing them from the rear of cavities 11.

To assemble, terminals 20, attached to cables 30, are introduced into cavities 11 from the rear thereof. When terminals 20 have been fully inserted, lances 24 spring outwardly (as shown in FIG. 2) and abut stop surfaces 18. Retainers 40 are then moved forward from the release position to the engagement position. When this is accomplished, retainer projections 43 enter cavities 11 through detent openings 14 and bear against the slanted surface of stop surface 18. This slanted surface, as well as engagement slots 45 coating with outer pin 15 and inner pin 16 also draw retainers 40 against housing 10. In particular, as seen in FIG. 3, engagement slots 45 ride up over inner pin 16 which serves to lock retainers 40 in place.

A second embodiment of the present Invention is shown in FIGS. 6 to 12. Housing 60 includes cavities 61 with insertion openings 62 at the front thereof. Stop surfaces 63 are located adjacent lances 74 which are in abutment therewith when retainer 90 is in its engagement position. Female connectors 73 include terminals 70, wire barrels 71, and insulating barrels 72. Terminals 70 are mounted on cables 80 and are provided with stabilizers 75. Lances 74 are adjacent tool openings 67 and stabilizers 75 ride in guide grooves 64 for additional stability.

Figure 8:
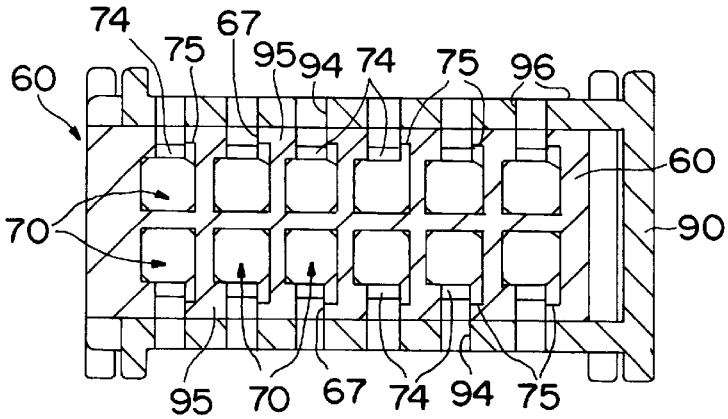
FIG. 8 is a vertical cross section of FIG. 6 as seen from the front with the retainer in the release position.
Figure 9:
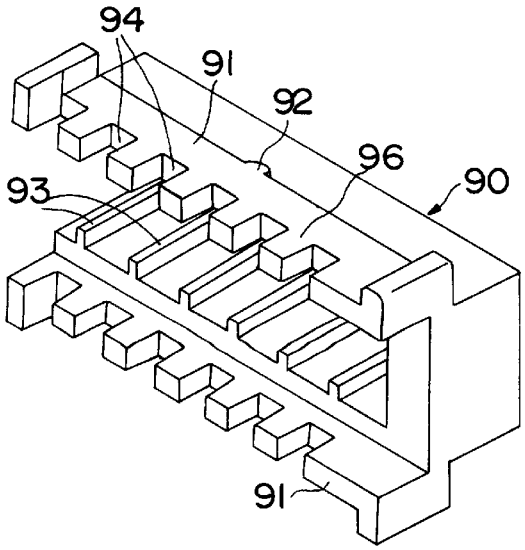
FIG. 9 is a perspective view of the retainer of the second embodiment of this Invention.
Figure 12:
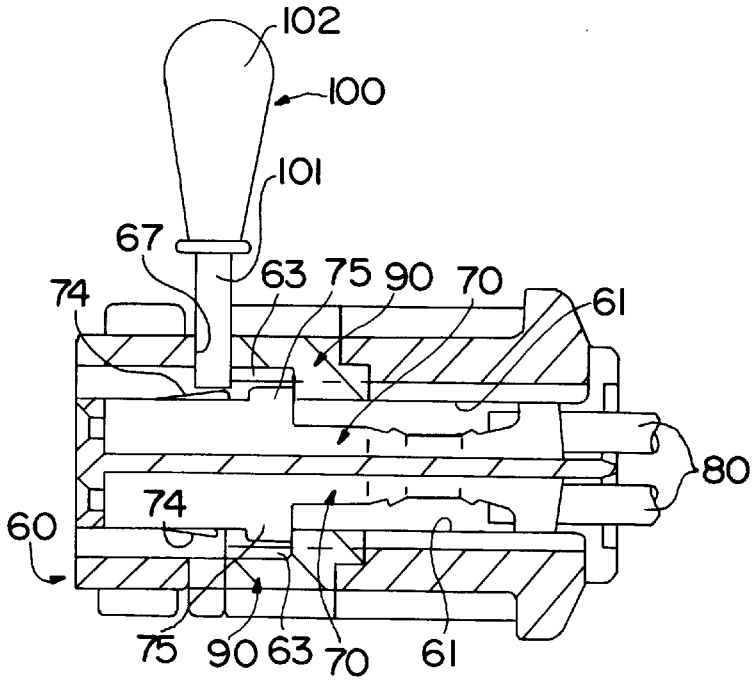
FIG. 12 is a vertical cross section of the connector of FIG. 10 showing the tool in use.

The structure of retainer 90 is best shown in FIG. 9. Sliding plates 91 are the upper and lower surfaces and each is provided, on its inner surface, with a plurality of terminal projections 93. These correspond to cavities 61 (see FIG. 7). Retainer 90 is shown in FIG. 8 in its release position. It is shifted to the right so that access openings 94 are in alignment with tool openings 67. Thus, as shown in FIG. 12, tool 100, having grip 102, can be inserted through access opening 94 and tool opening 67 so that pressure pin 101 bears against lance 74. As in the first embodiment of the Invention, lance 74 is pressed out of abutment with stop surface 63, thereby releasing terminal 70 for withdrawal from housing 60. Thus, when retainer 90 is shifted transversely to the insertion direction of female connectors 73, terminal projections 93 are moved against corresponding walls of cavities 61, out of the withdrawal paths of terminals 70.

Figure 10:
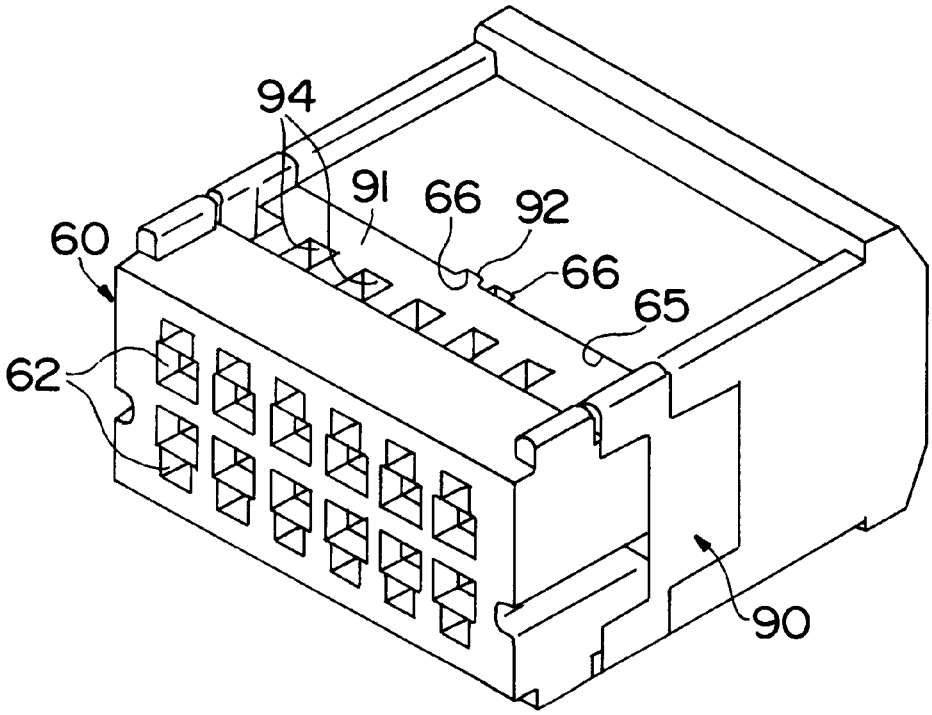
FIG. 10 is a perspective view of the connector of FIG. 6 with the retainer in its engagement position.
Figure 11:
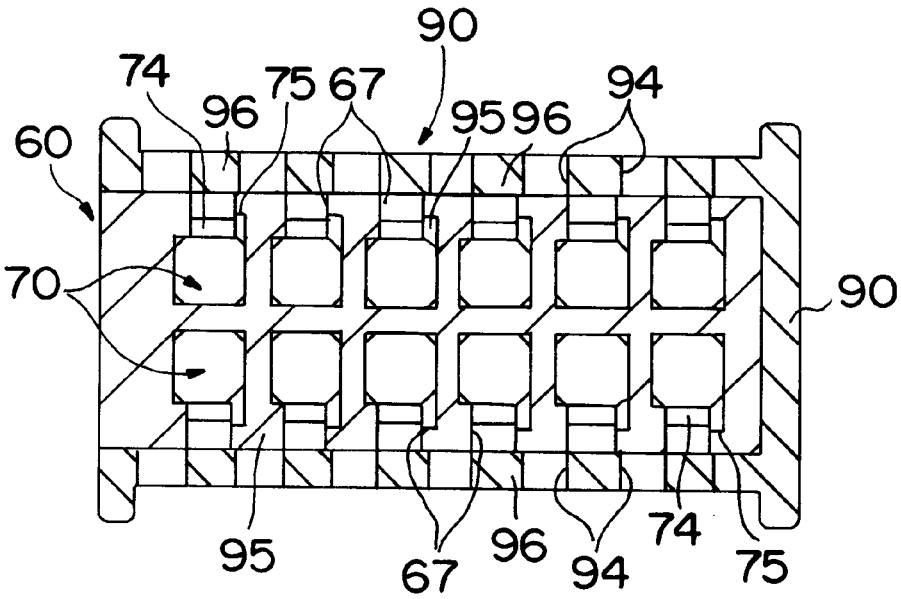
FIG. 11 is a vertical cross section of the connector of FIG. 10 as seen from the front.

The engagement position of retainer 90 is shown in FIGS. 10 and 11. Retainer 90 has been moved to the left (as shown in FIG. 11) so that closures 96 overlie tool openings 67, thereby sealing them and preventing entry of any unwanted foreign matter. In the engagement position (FIG. 8) closures 96 rest on separators 95 so that tool openings 67 are accessible.

In a preferred form of the second embodiment of the Invention, slidable plate 91 of retainer 90 is provided with tab 92 extending toward the rear of housing 60. Adjacent thereto, housing 60 carries receptacles 66 into which tab 92 extends. As retainer 90 is moved between its engagement position and its release position, tab 92 moves to the ends of receptacle 66. This provides a positive stop at each extreme of movement of retainer 90. The natural resilience of retainer 40 and its loose fit on housing 60 permit it to ride over the partition in receptacle 66.

Figure 13:
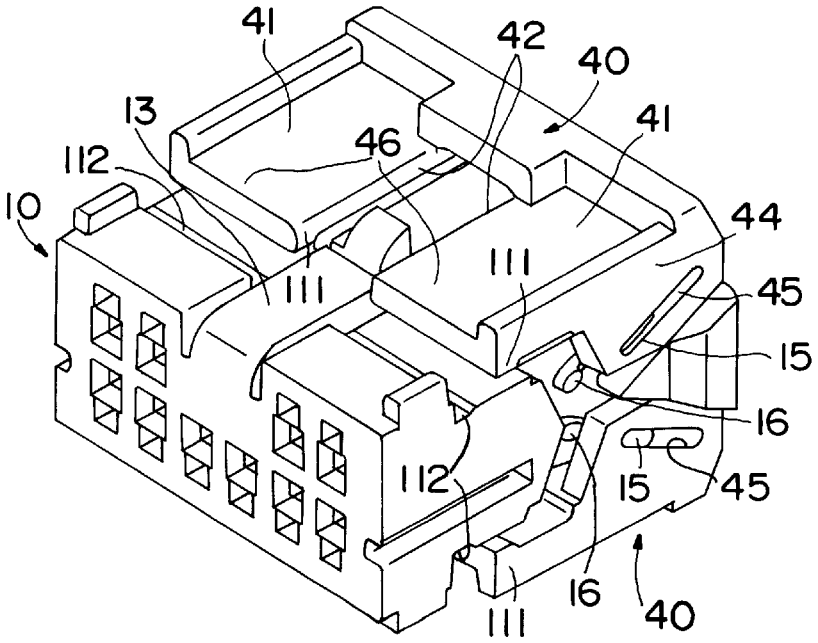
FIG. 13 is a perspective view, similar to that of FIG. 1, of a modification of the first embodiment of the present Invention.

With reference to FIG. 3, the connector of the first embodiment of the present Invention provides a substantial gap between the edge of closure 46 and the walls of housing 10 wherein tool openings 17 are formed. If a plurality of bundles of such wires are stored adjacent one another, there is a tendency for a cable from one of the wire bundles to be caught in the gap of a connector from another bundle. Thus, when the operator reaches for one bundle, the other may be damaged or the cables separated from the corresponding connector. The modification of FIGS. 13 to 15 is intended to overcome this drawback.

Figure 14:
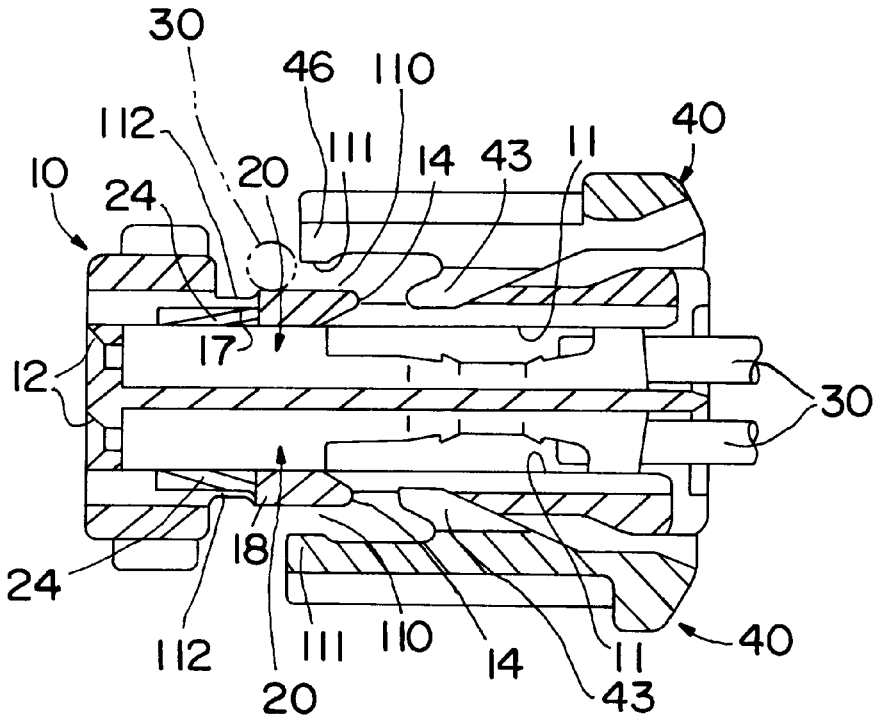
FIG. 14 is a vertical cross section of the connector of FIG. 13.
Figure 15:
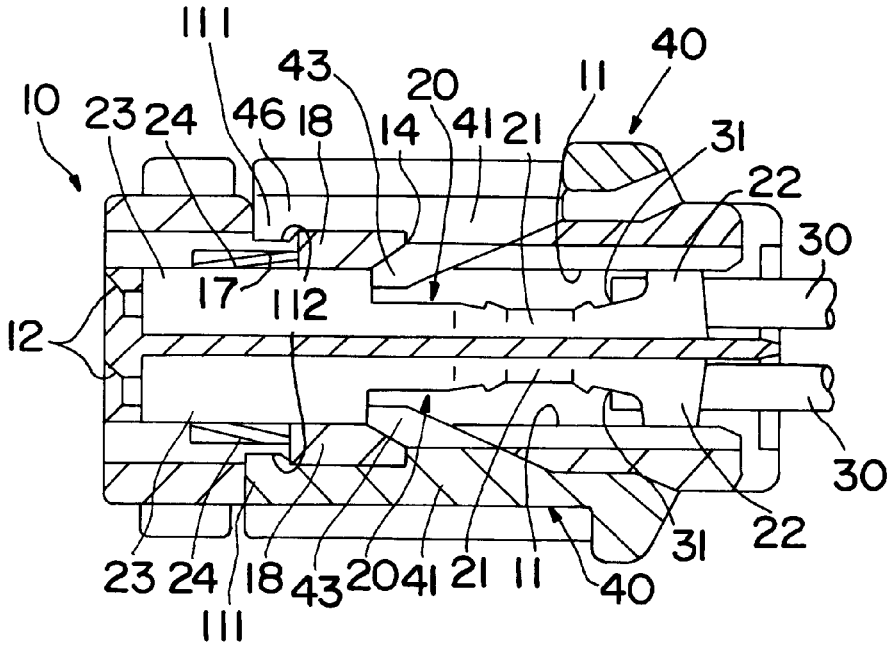
FIG. 15 is a view, similar to that of FIG. 14, of the connector with the retainer in the release position.

As is particularly shown in FIG. 14, closure 46 is provided with ridge 111 which narrows gap 110 between closure 46 and stop surface 18 so that it is smaller than the diameter of cable 30, thereby effectively preventing entanglement. When this embodiment is moved into its engagement position, ridge 111 fits into retaining groove 112, thereby securing retainer 40 to housing 10. The remaining elements of this modification are the same as those of the first embodiment. Of course, the ridge and the retaining groove could be interchanged so that the latter is on closure 46 and the former on stop surface 18.

Figure 16:
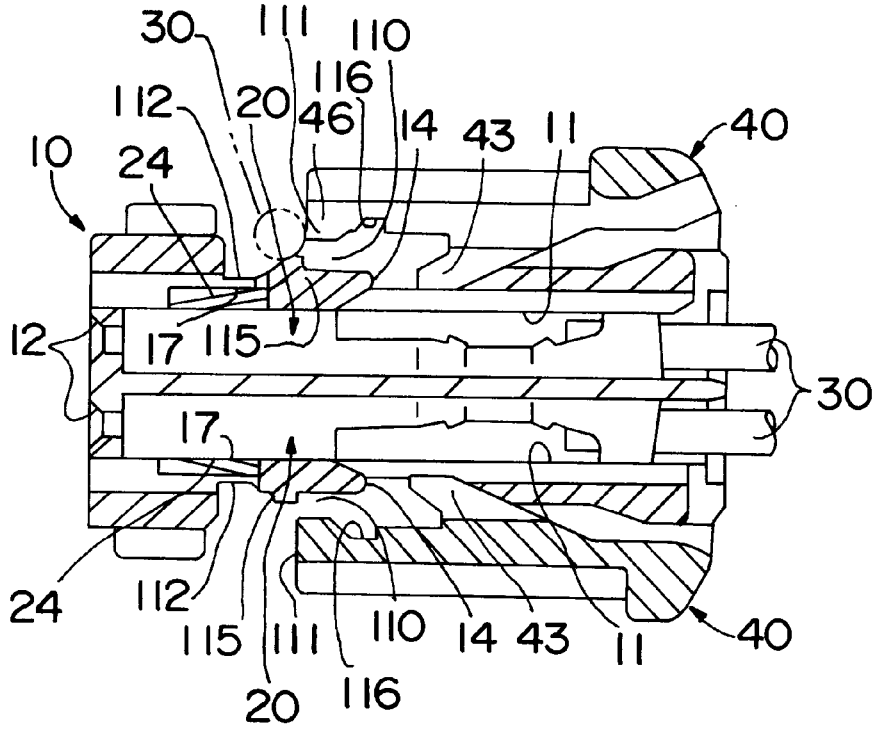
FIG. 16 is a vertical cross section, similar to that of FIG. 1, of a further modification of the present Invention with the retainer in the release position.
Figure 17:
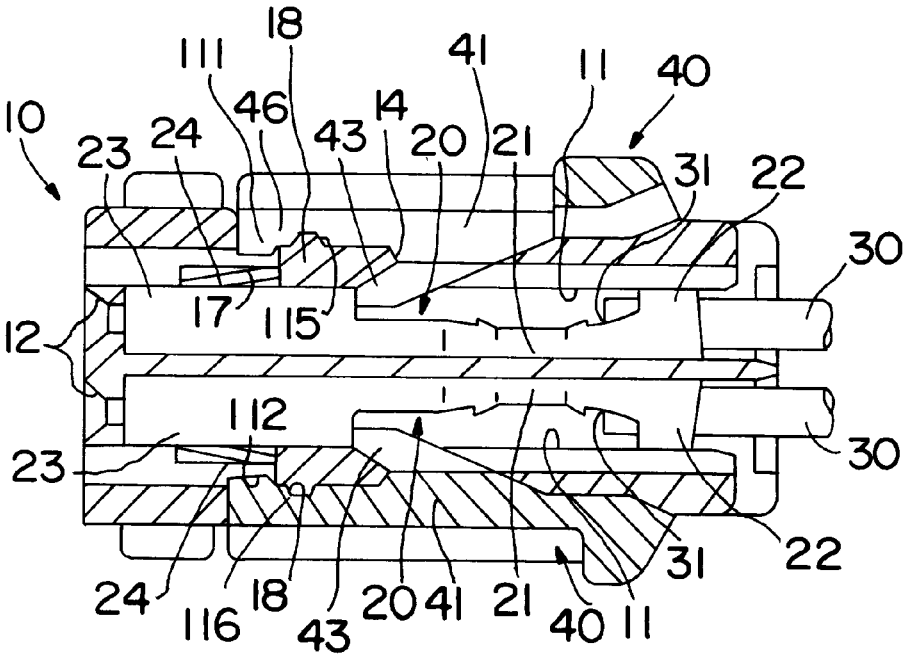
FIG. 17 is a view, similar to that of FIG. 16, with the retainer in the engagement position.

FIGS. 16 and 17 show a further modification. In addition to ridge 111 on closure 46, there is provided blocking tab 115 on stop surface 18. Correspondingly, blocking tab 115 fits into receiving groove 116 when retainer 40 is in its engagement position as shown in FIG. 17.

Although only a limited number of specific embodiments of the present Invention have been expressly disclosed, such changes or modifications as would be apparent to the person of ordinary skill may be made without departing from the scope or spirit thereof. For example, although ridge 111 is shown as extending across the entire width of closure 46, it is not essential that this be the case. Thus, ridge 111 could be interrupted along its longitudinal dimension, or otherwise occupy less than all of the width. In this case, it is particularly advantageous if ridge 111 is aligned with tool openings 17 so that, when retainer 40 is moved to its engagement position, ridge 111 will extend into tool openings 17. This will take the place of retaining groove 112.

Thus, the present Invention is intended to be broadly construed and not to be limited except by the character of the claims appended hereto.

What we claim is:

1. A locking connector, for use in connection with at least one insulated cable, comprising a housing and at least one retainer, said housing containing at least one cavity, a terminal in said cavity adapted for electrical connection to a complementary mating element, a lance on said terminal adapted to abut a stop surface on said housing to prevent withdrawal of said terminal from said housing, a tool opening in said housing aligned with said lance, said retainer, comprising a closure, having an engagement position, wherein said closure covers said tool opening, and a release position, wherein said closure does not cover said tool opening, said tool opening, when said retainer is in said release position, is adapted to permit introduction of a tool therethrough to exert pressure on said lance, thereby moving said lance out of abutment with said stop surface and permitting withdrawal of said terminal from said cavity, a detent on said retainer which, when said retainer is in said engagement position, bears against a portion of said terminal, thereby to prevent withdrawal thereof from said cavity, said detent being out of a withdrawal path of said terminal when said retainer is in said release position.

2. The locking connector of claim 1 wherein said detent is a retainer projection, a detent opening in said housing adjacent said terminal, thereby permitting said retainer projection to extend through said detent opening into said cavity when said retainer is in said engagement position.

3. The locking connector of claim 1 wherein said housing comprises a front face adapted to face said mating element, a rear face spaced apart from and opposite said front face, a pair of side walls extending from said front face to said rear face, side faces on said retainer parallel to and adjacent said side walls, an elongated engagement slot in each of said side faces, an outer pin or each of said side walls extending into said slot, whereby said retainer is movably secured to said housing.

4. The locking connector of claim 3 wherein said slot is angled toward a vertical center of said housing in an insertion direction of movement of said retainer from said release position to said engagement position.

5. The locking connector of claim 4 wherein there is an inner pin on each of said side walls spaced apart from said outer pin in said insertion direction and aligned with a longitudinal axis of said elongated slot, said inner pin being in said slot when said retainer is in said engagement position and outside said slot when said retainer is in said release position.

6. The locking connector of claim 2 wherein said detent opening has a detent edge slanting toward a vertical center of said housing in an insertion direction of said retainer, said retainer projection having a retainer edge complementary to said detent edge, said retainer edge in contact with said detent edge as said retainer is moved in said insertion direction.

7. The locking connector of claim 1 wherein there are two retainers, one on a top of said housing and one on a bottom of said housing.

8. The locking connector of claim 1 wherein said housing comprises a front face, adapted to face said mating element, a rear face spaced apart from and opposite said front face, a first surface extending between said front face and said rear face, said retainer having a planar main plate parallel to and adjacent said first surface, a first ridge, transverse to an insertion direction of movement of said retainer from said release position to said engagement position, extending from said main plate toward said first surface, a first retaining groove in said first surface complementary to said first ridge, whereby said first ridge is in said first retaining groove when said retainer is in said engagement position and is not in said groove when said retainer is in said release position.

9. The locking connector of claim 8 wherein said housing has a second surface parallel to said first surface and spaced apart therefrom, a second ridge, transverse to an insertion direction of movement of said retainer from said release position to said engagement position, extending from said main plate toward said second surface, a second retaining groove in said second surface complementary to said second ridge, whereby said second ridge is in said second retaining groove when said retainer is in said engagement position and not in said groove when said retainer is in said release position.

10. The locking connector of claim 8 wherein said ridge extends across said main plate.

11. The locking connector of claim 8 wherein said ridge extends intermittently across said main plate.

12. The locking connector of claim 8 wherein, when said retainer is in said release position, there is a gap between said ridge and said housing, said gap being less than a diameter of said cable.

13. The locking connector of claim 1 wherein said housing comprises a front face, adapted to face said mating element, a rear face spaced apart from and opposite said front face, a first surface extending between said front face and said rear face, said retainer having a planar main plate parallel to and adjacent said first surface, a first ridge, transverse to an insertion direction of movement of said retainer from said release position to said engagement position, extending from said first surface toward said main plate, a retaining groove in said main plate complementary to said ridge, whereby said first ridge is in said first retaining groove when said retainer is in said engagement position and is not in said groove when said retainer is in said release position, there being a gap between said between said first ridge and said main plate when said retainer is in said release position, said gap being less than a diameter of said cable.

14. The locking connector of claim 8 wherein said gap is defined by a blocking tab on said housing extending toward said ridge.

15. The locking connector of claim 1 wherein said terminal is introduced into said cavity in an insertion direction, said retainer adapted for movement from said release position to said engagement position in said insertion direction.

16. The locking connector of claim 1 wherein said terminal is introduced into said cavity in an insertion direction, said retainer adapted for movement from said release position to said engagement position transverse to said insertion direction.

17. The locking connector of claim 16 wherein said retainer has a terminal projection extending into said cavity, said terminal projection being in a withdrawal path of said terminal when said retainer is in said engagement position, and out of said path when said retainer is in said release position.

18. The locking connector of claim 16 wherein said retainer has a terminal projection extending into said cavity, said terminal projection abutting said terminal when said retainer is in said engagement position and being out of a withdrawal path of said terminal when said retainer is in said release position.

19. The locking connector of claim 16 comprising an elongated receptacle having a retaining axis transverse to said insertion direction, a tab on said retainer extending into said receptacle whereby movement of said retainer transverse to said insertion direction is limited.

20. The locking connector of claim 1 wherein said housing comprises a front face, adapted to face said mating element, a rear face, spaced apart from and opposite said front face, a first surface extending between said front face and said rear face, said retainer having a planar main plate parallel to and adjacent said first surface, a first ridge transverse to a direction of movement of said retainer from said release position to said engagement position, extending across less than all of said main plate, said ridge being adjacent said tool opening whereby, when said retainer is in said engagement position, said ridge is in said tool opening.

* * * * *